US005608194A

United States Patent [19]

Okazaki et al.

[11] Patent Number: 5,608,194

[45] Date of Patent: Mar. 4, 1997

[54] EXHAUST PIPE STRUCTURE FOR A MOTORCYCLE

[75] Inventors: Hiroshi Okazaki; Akihiro Hamada; Hiroo Takemura; Kazuto Takatori, all of Saitama, Japan

[73] Assignee: Honda Giken Kogyo Kabushiki Kaisha, Tokyo, Japan

[21] Appl. No.: 476,574

[22] Filed: Jun. 7, 1995

[30] Foreign Application Priority Data

Jul. 13, 1994 [JP] Japan ..... 6-161516

[51] Int. Cl.[6] ..... F01N 7/08

[52] U.S. Cl. ..... 181/228; 181/238; 181/272

[58] Field of Search ..... 181/227, 228, 181/238, 239, 240, 264, 269, 272, 273, 276, 281, 282; 60/313, 323

[56] References Cited

U.S. PATENT DOCUMENTS

| | | | |
|---|---|---|---|
| 2,009,343 | 7/1935 | Peik | 181/264 |
| 4,133,479 | 1/1979 | Musitano et al. | 181/264 X |
| 4,359,865 | 11/1982 | Nakao et al. | 60/313 |
| 4,819,428 | 4/1989 | Ciccarone | 181/240 X |
| 4,949,807 | 8/1990 | Hirata et al. | 181/240 |
| 5,010,731 | 4/1991 | Onishi | 60/313 |

FOREIGN PATENT DOCUMENTS

| | | |
|---|---|---|
| 62-66214 | 4/1987 | Japan . |

*Primary Examiner*—Khanh Dang
*Attorney, Agent, or Firm*—Birch, Stewart, Kolasch & Birch, LLP

[57] ABSTRACT

To provide a compact exhaust apparatus for allowing exhaust sounds of each cylinder to be heard. A muffler includes a tubular member the inside of which is divided into three independent expansion paths by partition plates. The partition plates extend in an axial direction. Each of the expansion paths is divided into a first expansion chamber, a second expansion chamber and a third expansion chamber by diametrical partitions. The first expansion chamber and the second expansion chamber are in communication with each other by way of a pipe while the second expansion chamber and the third expansion chamber are communicated with each other by way of a second pipe. A tail pipe is connected to each pipe to discharge exhaust gas to the outside.

18 Claims, 9 Drawing Sheets

EXHAUST PIPE STRUCTURE FOR A MOTORCYCLE

BACKGROUND OF THE INVENTION

1. Field of the Invention

An exhaust pipe structure for a multi-cylinder engine of a motorcycle wherein the exhaust sound of each cylinder can be heard.

2. Description of Background Art

Motorcycles of a comparatively large displacement wherein a four-cylinder or six-cylinder engine is carried have a structure with exhaust pipes extending from the cylinders of the engine which are gathered into a single muffler to exhaust gas. In the alternative, a muffler may be connected to each exhaust pipe.

Another structure wherein four exhaust pipes are joined together two by two into mufflers is proposed in Japanese Utility. Model Laid-Open No. Sho 62-66214.

SUMMARY AND OBJECTS OF THE INVENTION

In the case of a multi-cylinder engine, the condition of the engine can be judged by listening to exhaust sounds of the cylinders. An agreeable tone can be produced by generating exhaust sounds for each cylinder. However, when a plurality of exhaust pipes are gathered together, this effect cannot be exhibited.

On the other hand, when a muffler is connected to each of the exhaust pipes and a plurality of exhaust pipes are not gathered together, the effect described above can be exhibited. However, in this embodiment, the weight and the cost of manufacturing is increased.

In the present invention, an exhaust pipe structure for a motorcycle is constructed such that a muffler is connected to downstream ends of exhaust pipes extending from cylinders of a multi-cylinder engine. The muffler is constructed such that it includes a single tubular member the inside of which is divided into a number of independent expansion paths equal to the number of the cylinders of the engine.

Further, tail pipes may be individually connected to downstream ends of the independent expansion paths, and the tail pipes may be accommodated in a single cover.

Gas exhausted from the cylinders of the engine is discharged, for each cylinder, to the outside by way of the exhaust pipes, the muffler and the tail pipes.

Further scope of applicability of the present invention will become apparent from the detailed description given hereinafter. However, it should be understood that the detailed description and specific examples, while indicating preferred embodiments of the invention, are given by way of illustration only, since various changes and modifications within the spirit and scope of the invention will become apparent to those skilled in the art from this detailed description.

BRIEF DESCRIPTION OF THE DRAWINGS

The present invention will become more fully understood from the detailed description given hereinbelow and the accompanying drawings which are given by way of illustration only, and thus are not limitative of the present invention, and wherein.

DETAILED DESCRIPTION OF THE PREFERRED EMBODIMENTS

Figure 1:
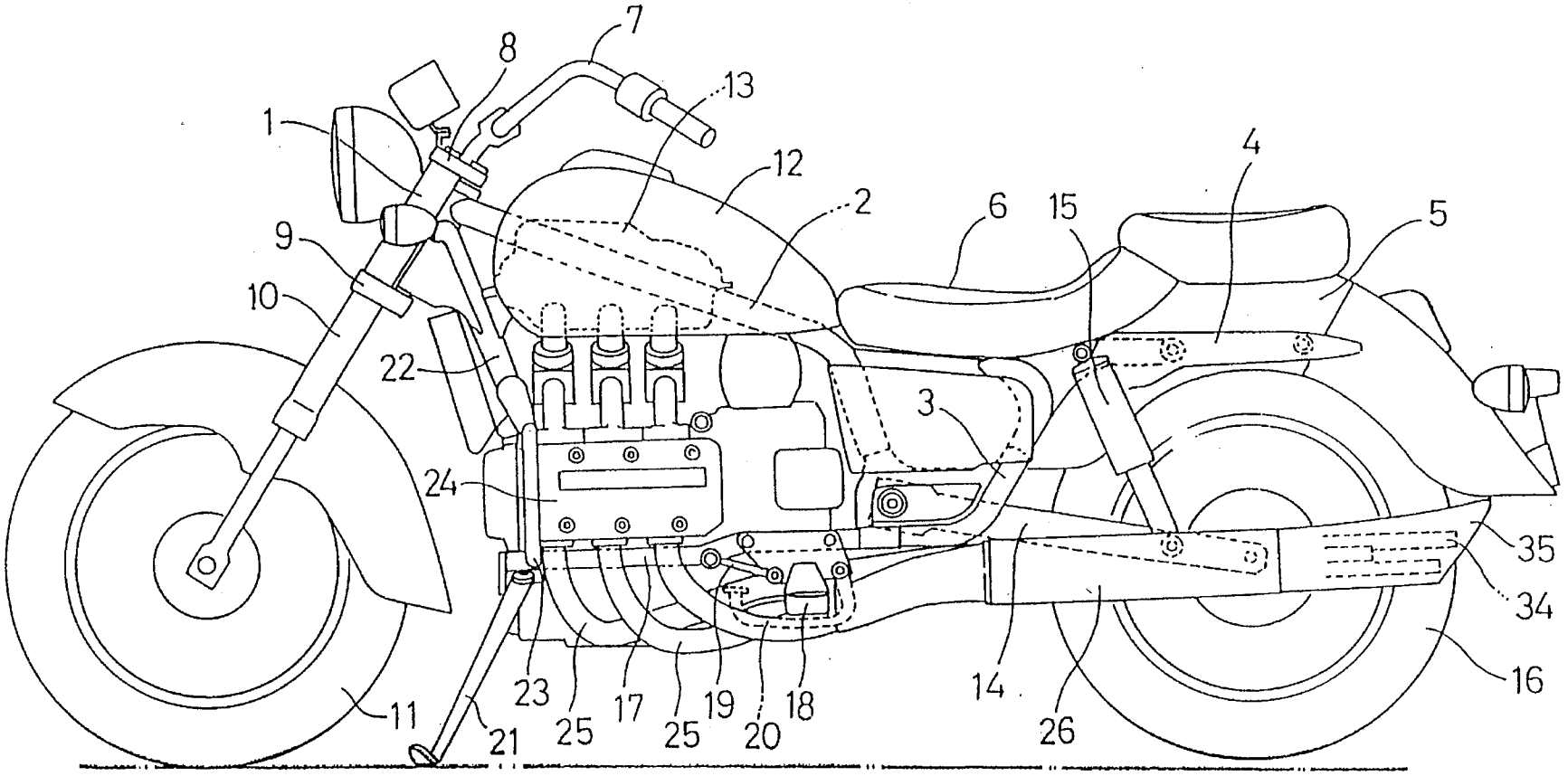
FIG. 1 is a side elevational view of an entire motorcycle to which an exhaust pipe structure according to the present invention is applied.
Figure 2:
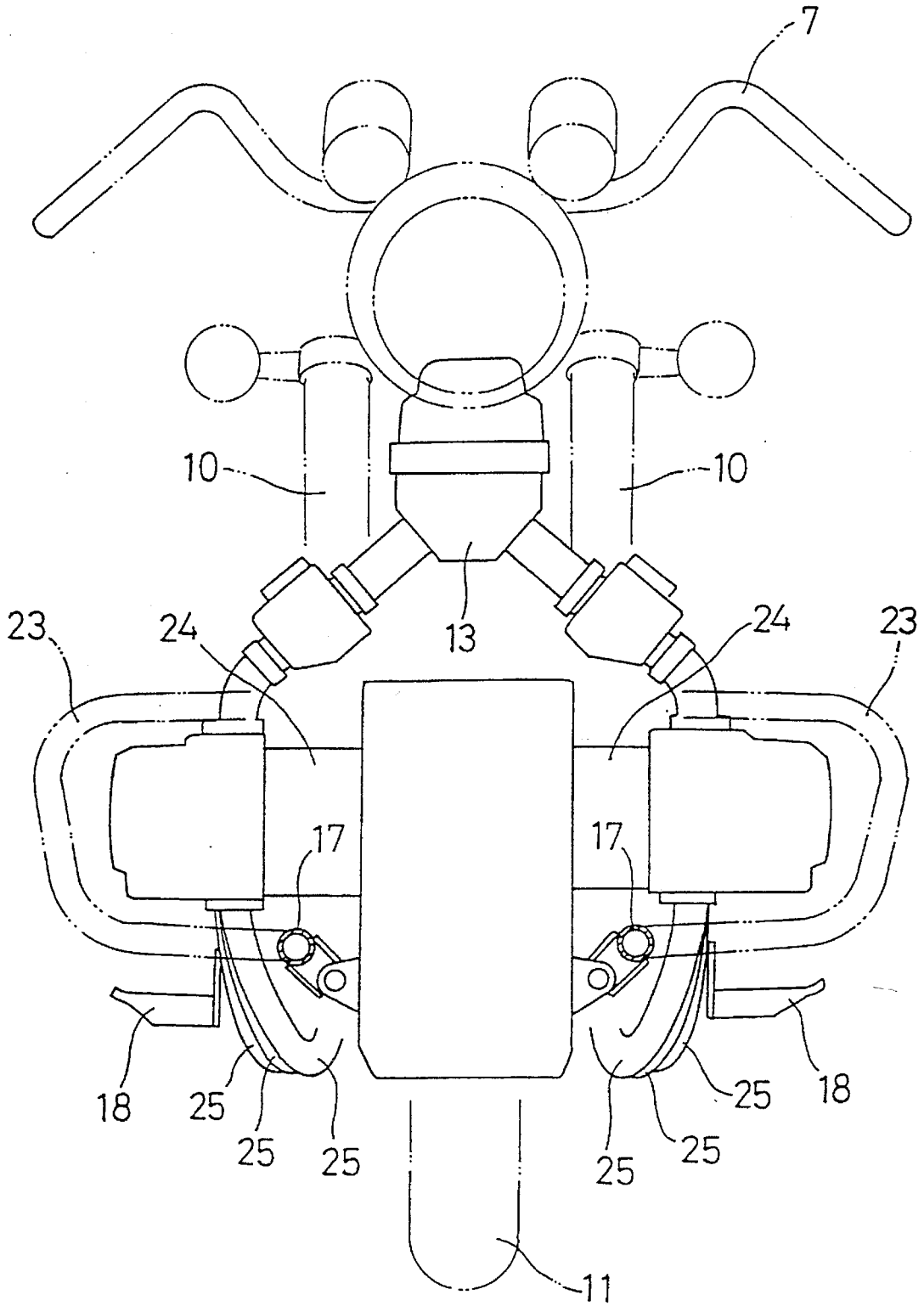
FIG. 2 is a front elevational view of the motorcycle.
Figure 3:
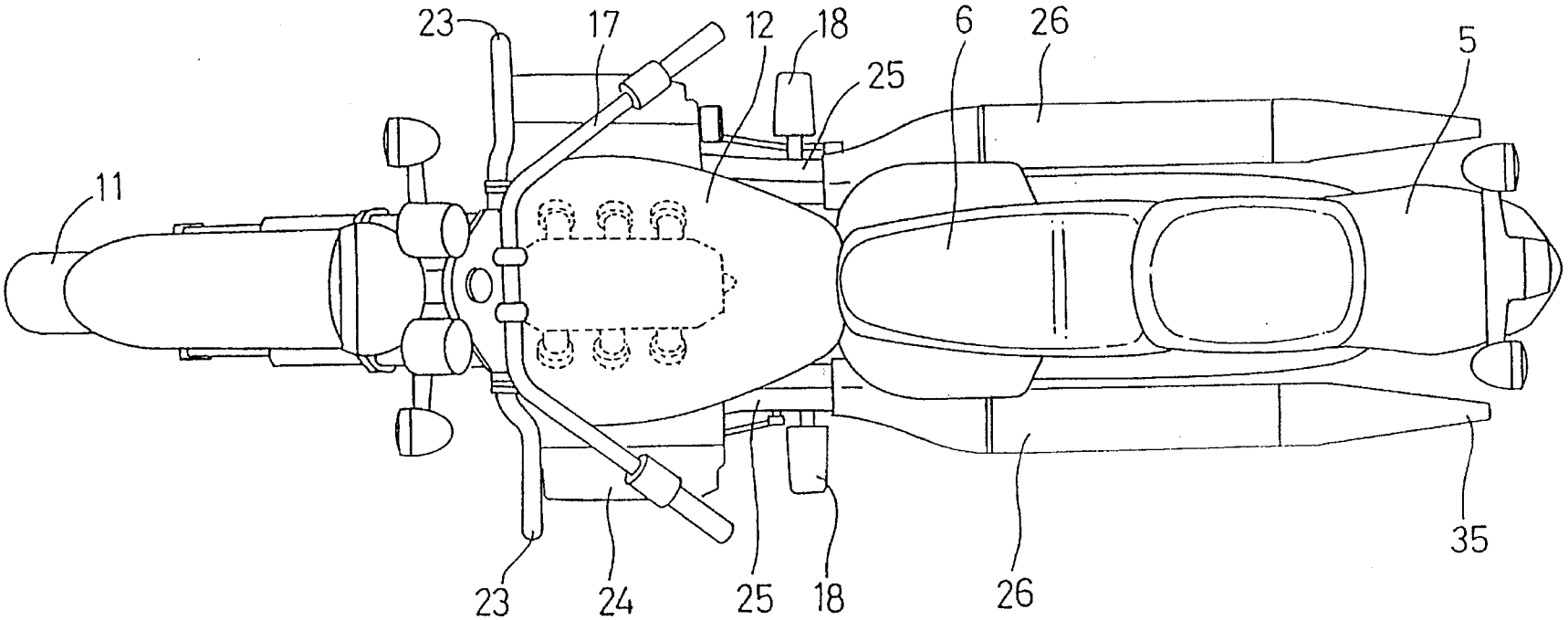
FIG. 3 is a plan view of the motorcycle.
Figure 4:
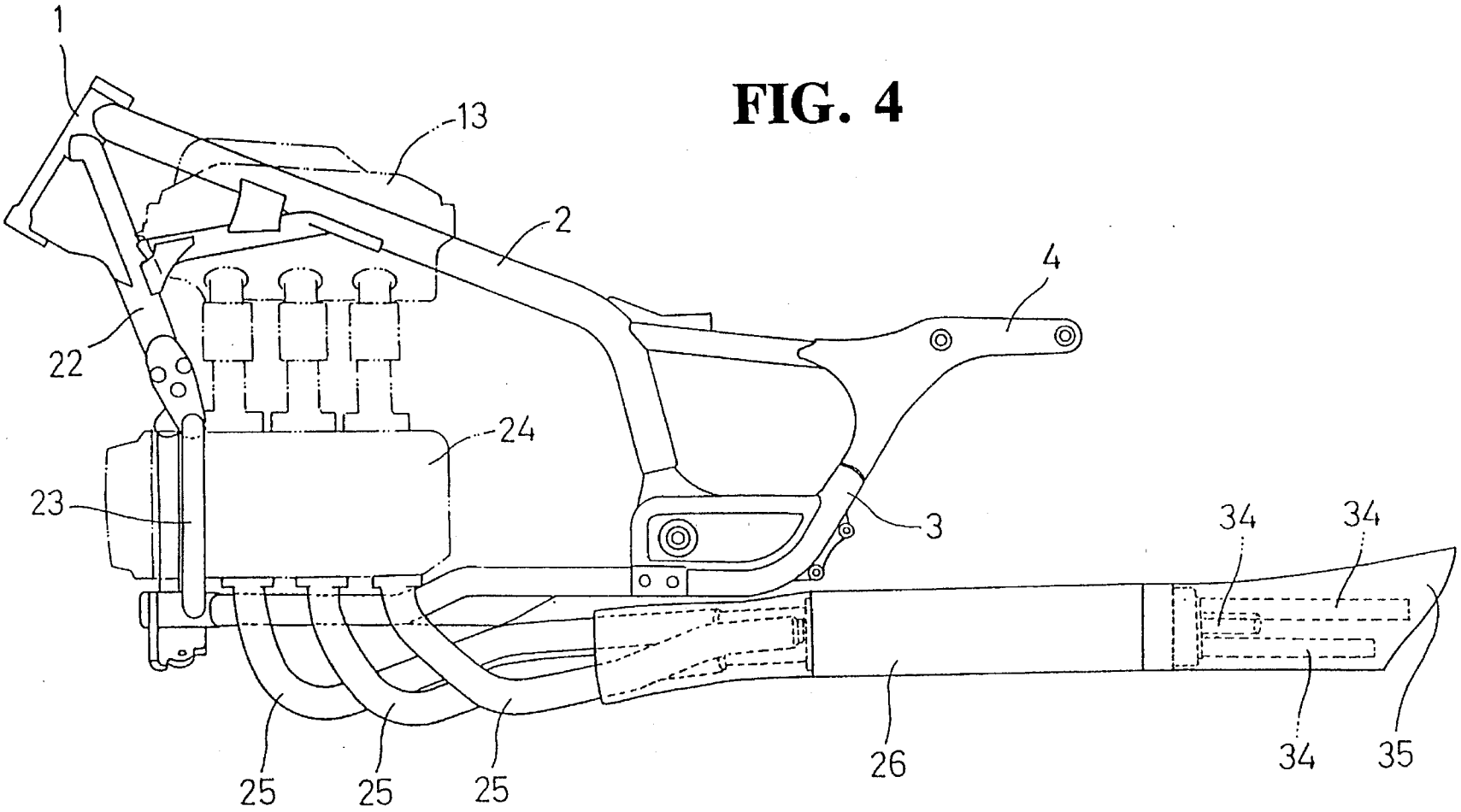
FIG. 4 is a side elevational view showing a frame and an exhaust system of the motorcycle.

An embodiment of the present invention will be described below with reference to the accompanying drawings. FIG. 1 is a side elevational view of an entire motorcycle to which an exhaust pipe structure according to the present invention is applied. FIG. 2 is a front elevational view of the motorcycle. FIG. 3 is a plan view of the motorcycle. FIG. 4 is a side elevational view showing a frame and an exhaust system of the motorcycle. The motorcycle includes a main frame 2 extending obliquely rearwardly downwards from a head pipe 1, and a rear frame 3 and a seat rail 4 extend obliquely rearwardly upwards from a lower end of the main frame 2. A rear fender 5 is mounted on the rear frame 3. The seat rail 4 and a seat 6 is supported on the rear fender 5.

Further, a steering shaft which is rotated by a handle bar 7 is fitted in-the head pipe 1. An upper bridge 8 is mounted at an upper end of the steering shaft while a lower bridge 9 is mounted at a lower end of the steering shaft. Upper halves of a pair of left and right front forks 10 are held between the upper bridge 8 and the lower bridge 9, and a shaft of a front wheel 11 is supported at lower ends of the pair of left and right front forks 10.

A fuel tank 12 is mounted in such a manner as to extend across the main frame 2. An air cleaner 13 is disposed below the fuel tank 12 while a swing arm 14 is supported at a front end thereof for pivotal motion at a lower end of the main frame 2. A shock absorber 15 is provided between an intermediate portion of the swing arm 14 and the rear frame 3. A shaft of a rear wheel 16 is supported at a rear end of the swing arm 14.

Further, a subframe 17 extends forwardly from a lower end of the main frame 2. A step 18, a change lever 19, a brake pedal 20 and a stand 21 are supported on the subframe 17 by way of a bracket.

A down frame 22 extends downwardly from the head pipe 1. An engine guard pipe 23 which extends sidewardly as viewed from the front is mounted between a lower end of the down frame 22 and a front end of the sub frame 17. A horizontal six-cylinder engine 24 is carried in a space defined by the main frame 2, the sub frame 17, the down frame 22 and the engine guard pipe 23.

Figure 5:
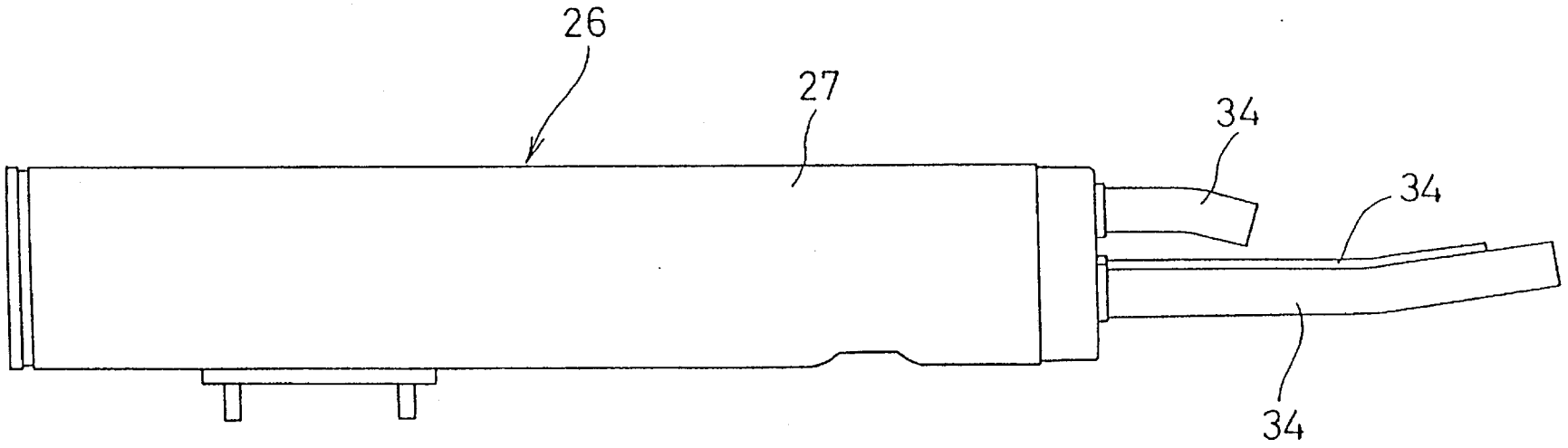
FIG. 5 is a plan view of a muffler.
Figure 6:
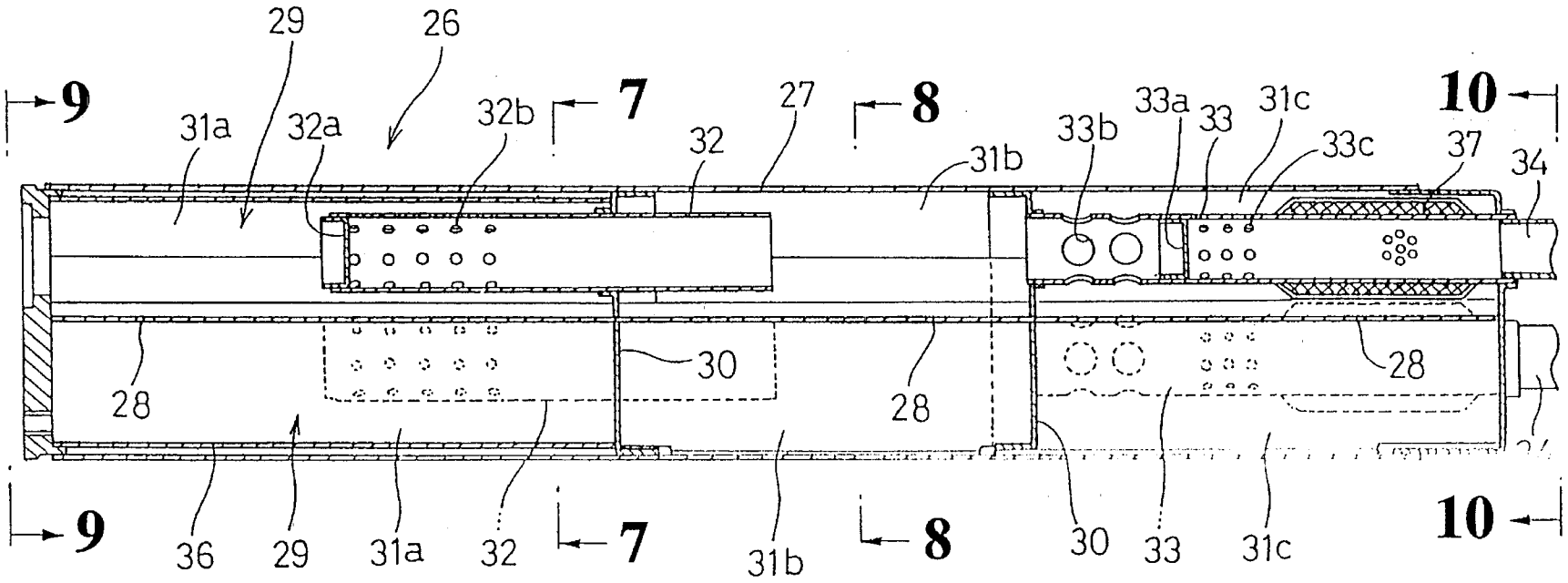
FIG. 6 is a vertical sectional view taken along an axial direction of the muffler.
Figure 7:
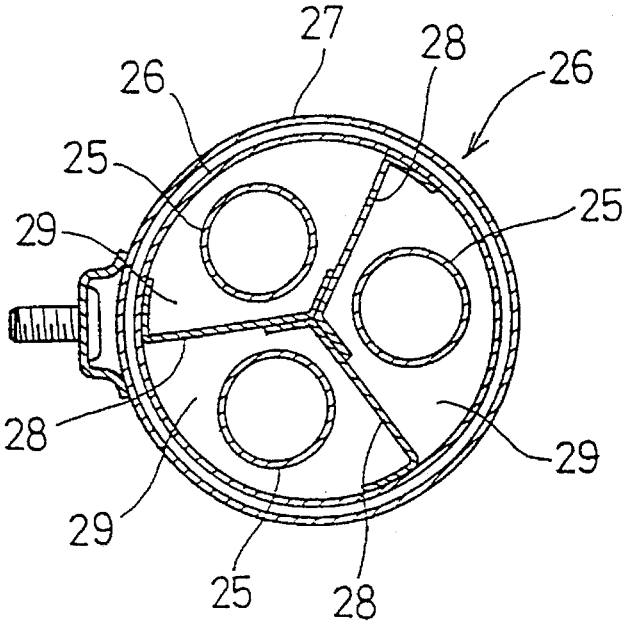
FIG. 7 is a sectional view taken along line 7—7 of FIG. 6.
Figure 8:
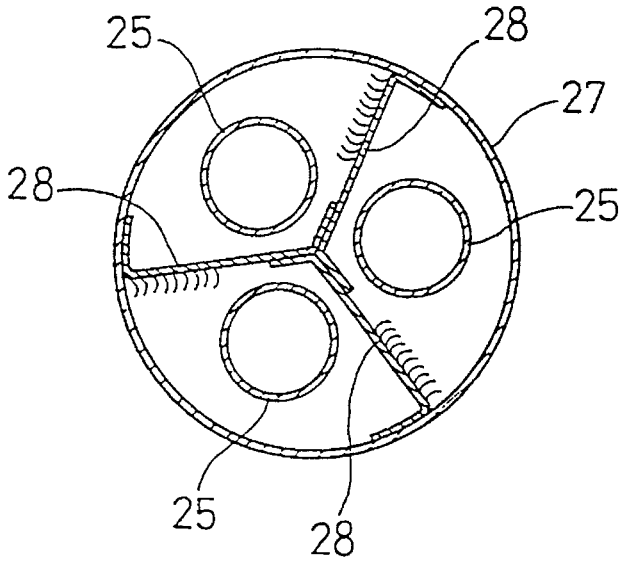
FIG. 8 is a sectional view taken along line 8—8 of FIG. 6.
Figure 9:
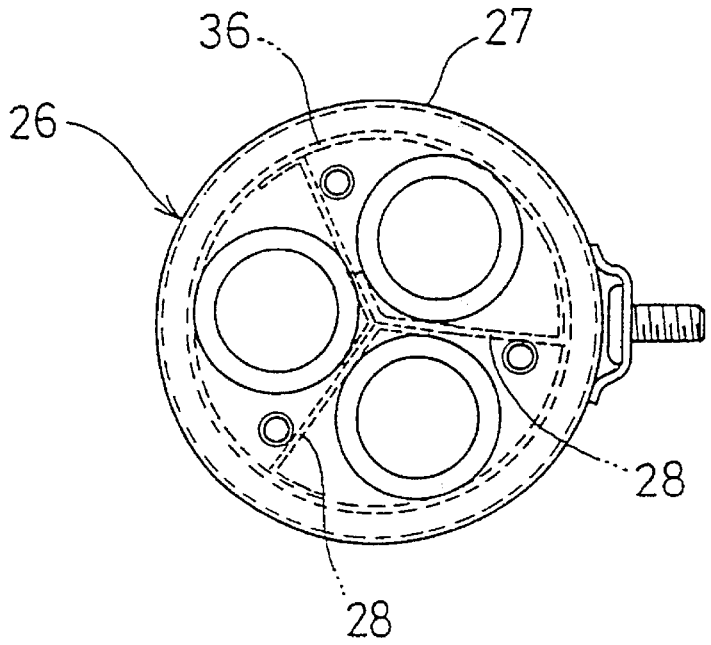
FIG. 9 is a view as viewed from a direction of 9—9 of FIG. 6.
Figure 10:
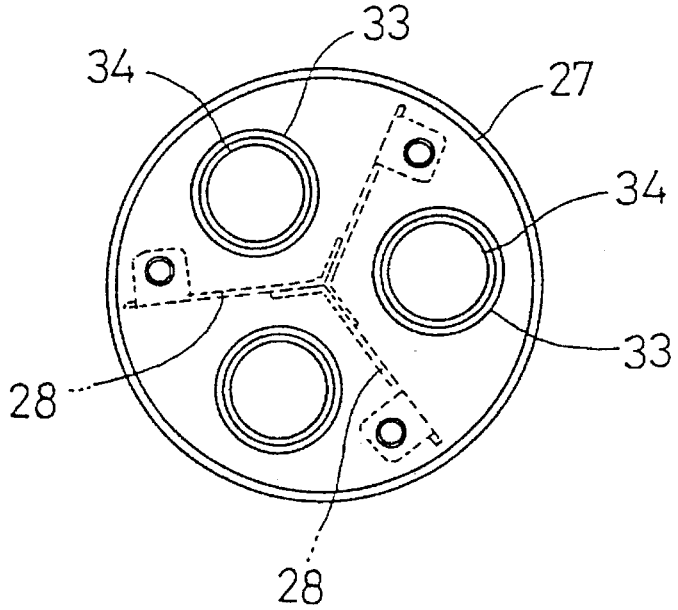
FIG. 10 is a view as viewed from a direction of 10—10 of FIG. 6.

Exhaust pipes 25 extend outwardly, three on each side, from the cylinders of the engine 24, and a muffler 26 is connected to downstream ends of the exhaust pipes 25. The structure of the muffler 26 will be described with reference to FIGS. 5 to 10. FIG. 5 is a plan view of the muffler. FIG. 6 is a vertical sectional view taken along an axial direction of the muffler. FIG. 7 is a sectional view taken along line 7—7 of FIG. 6. FIG. 8 is a sectional view taken along line 8—8 of FIG. 6. FIG. 9 is a view as viewed from the direction of 9—9 of FIG. 6. FIG. 10 is a view as viewed from the direction of 10—10 of FIG. 6.

The muffler 26 includes a tubular member 27 the inside of which is divided into three independent expansion paths 29 by partition plates 28. The partition plates 28 extend in the axial direction, and each of the expansion paths 29 is divided into a first expansion chamber 31*a*, a second expansion chamber 31*b* and a third expansion chamber 31*c* by diametrical partitions 30. The first expansion chamber 31*a* and the second expansion chamber 31*b* are communicated with each other by way of a pipe 32. The second expansion chamber 31*b* and the third expansion chamber 31*c* are communicated with each other by way of a pipe 33.

An end opening of the pipe 32 is closed with a blank cap 32*a*, and exhaust gas in the first expansion chamber 31*a* passes through small holes 32*b* of the pipe 32 and enters the second expansion chamber 31*b* through the pipe 32. Meanwhile, a blank cap 33*a* is provided also at an intermediate portion of the pipe 33. Exhaust gas in the second expansion chamber 31*b* enters the third expansion chamber 31*c* through holes 33*b* of a comparatively large diameter of the pipe 33. Further, the exhaust gas passes through small holes 33*c* of the pipe 33 and through the pipe 33 and is exhausted to the outside by way of a tail pipe 34 connected to each of the pipes.

Further, in order to adjust the length of the entire exhaust pipe, the tail pipes 34 are different for each expansion path 29, and the three tail pipes 34 are accommodated in a single cover 35 to assure a good appearance.

Tubular members 36 for heat insulation are disposed on the inner side of the tubular member 27 within the first expansion chambers 31*a* in order to prevent a variation in color or the like by exhaust gas of a high temperature. Further, a silencing member 37 is disposed on the outer periphery of each of the pipes 33.

Figure 11:
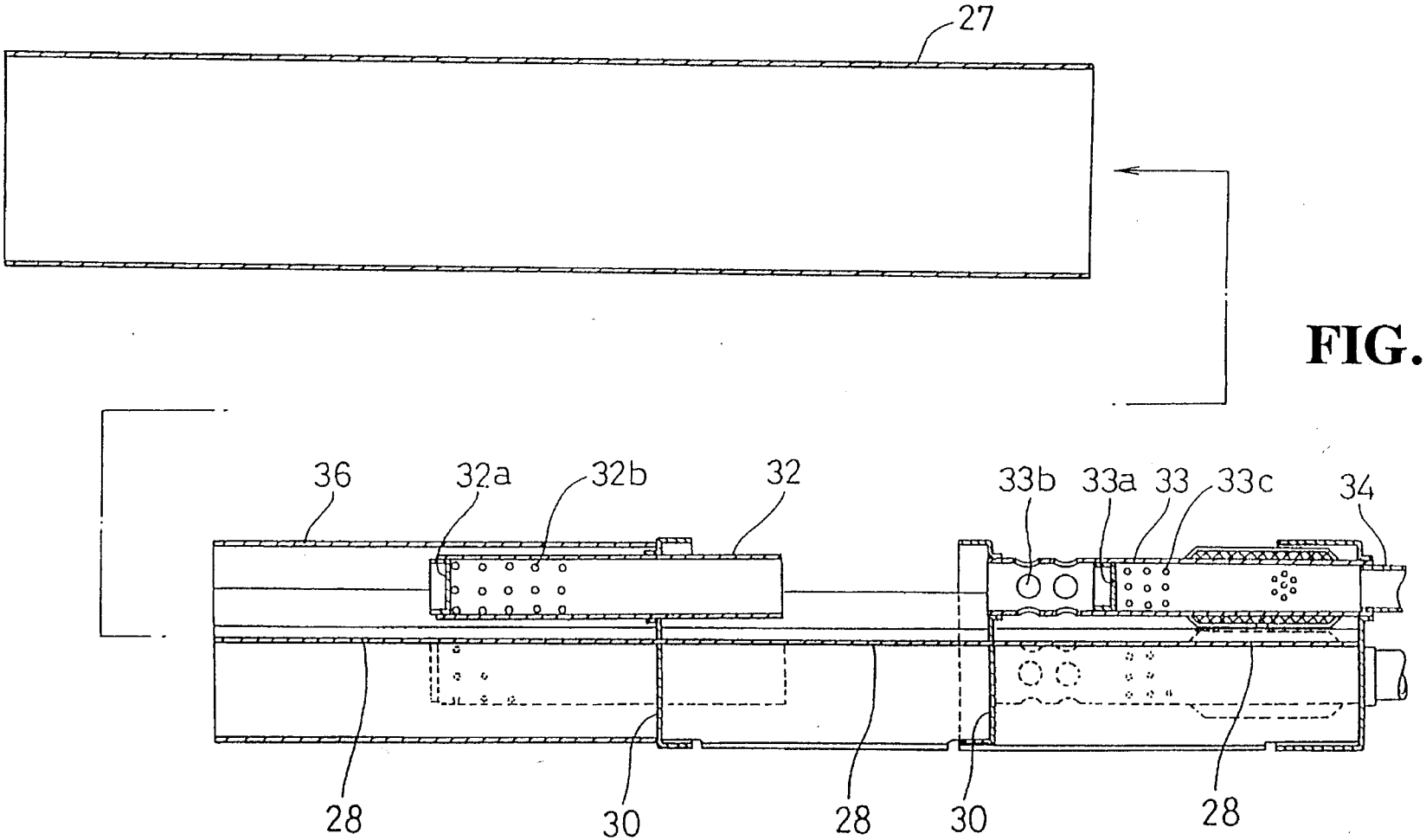
FIG. 11 is an exploded view showing a condition of the muffler before assembly.

By the way, in order to assemble the muffler 26 described above, the partition plates 28 and the partitions 30 are assembled and the pipes 32 and 33 are attached to the partitions 30 to form a unit as shown in FIG. 11, and the partially fabricated item in the form of a unit is pushed into the tubular member 27, whereafter spot welding or the like is performed, thereby completing the assembly.

In the foregoing, exhaust gas from the cylinders of the horizontal six-cylinder engine 24 first flows in the exhaust pipes and then enters the expansion paths 29 without mixing with each other. Then, while the exhaust gas passes the first expansion chambers 31*a*, the second expansion chambers 31*b* and the third expansion chambers 31*c* constituting the expansion paths 29, it is expanded, whereupon energy is consumed. Consequently, the exhaust sounds to be generated from the tail pipes are silenced.

As described in the foregoing, according to an exhaust pipe structure for a motorcycle in accordance with the present invention, since a muffler is connected to downstream ends of exhaust pipes led out from cylinders of a multi-cylinder engine and the muffler has such a structure that it includes a single tubular member the inside of which is divided into a number of independent expansion paths equal to the number of the cylinders of the engine, exhaust sounds of each cylinder can be heard without an increase in weight and an increase in cost. Accordingly, the conditions of the engine can be judged for each cylinder. Further, since the exhaust sounds are generated for each cylinder, an agreeable tone can be produced.

Also the appearance is improved, when the tail pipes are individually connected to downstream ends of the independent expansion paths of the muffler and the tail pipes are accommodated in a single cover.

The invention being thus described, it will be obvious that the same may be varied in many ways. Such variations are not to be regarded as a departure from the spirit and scope of the invention, and all such modifications as would be obvious to one skilled in the art are intended to be included within the scope of the following claims.

What is claimed is:

1. An exhaust pipe structure for a motorcycle comprising:

a muffler;

exhaust pipes adapted to extend from cylinders of a multi-cylinder engine, said exhaust pipes including upstream ends and downstream ends, said muffler being connected to said downstream ends of said exhaust pipes;

said muffler comprising:

a single tubular member having an interior portion forming a chamber;

partition plates for dividing the interior portion of said single tubular member into a plurality of independent expansion paths equal to the number of cylinders of an engine, said plurality of independent expansion paths including upstream ends and downstream ends; and tail pipes individually connected to said downstream ends of said independent expansion paths and a single cover for accommodating said tail pipes therein.

2. The exhaust pipe structure for a motorcycle according to claim 1, wherein said partition plates extend radially for forming three expansion chambers within said single tubular member.

3. The exhaust pipe structure for a motorcycle according to claim 2, and further including a first diametrical partition and a second diametrical partition positioned at predetermined locations along the length of said single tubular member for dividing each of said three expansion chambers into a first expansion chamber, a second expansion chamber and a third expansion chamber.

4. The exhaust pipe structure for a motorcycle according to claim 3, and further including a first pipe having a first end and a second end, said first end being in communication through said first diametrical partition with said first expansion chamber and said first end including a plurality of apertures therein for communicating said first expansion chamber with said second expansion chamber.

5. The exhaust pipe structure for a motorcycle according to claim 4, and further including a second pipe having a first end and a second end, said first end being in communication with said second expansion chamber and includes a plurality of apertures therein for communicating said second expansion chamber with said third expansion chamber.

6. The exhaust pipe structure for a motorcycle according to claim 5, wherein said second pipe includes a first portion with a plurality of apertures and a second portion with a plurality of apertures, a blank cap being disposed along the length thereof between said first and second portions for permitting exhaust gas to enter said third expansion chamber through said first portion and exit said muffler through said second portion.

7. The exhaust pipe structure for a motorcycle according to claim 6, and further including a silencing member operatively connected to said second pipe.

8. The exhaust pipe structure for a motorcycle according to claim 4, and further including a blank cap operatively mounted on said first pipe for permitting exhaust gas to enter said first pipe through said plurality of apertures therein.

9. The exhaust pipe structure for a motorcycle according to claim 3, and further including an inner tubular member for insulating heat being provided within said first expansion chamber.

10. A muffler for a motorcycle wherein said muffler is adapted to be connected to downstream ends of exhaust pipes adapted to extend from cylinders of a multi-cylinder engine comprising:

a housing having an interior portion forming a chamber;

partition plates for dividing the interior portion of said housing into a plurality of independent expansion paths equal to the number of cylinders of an engine; and tail pipes individually connected to downstream ends of said independent expansion paths and a single cover for accommodating said tail pipes therein.

11. The muffler for a motorcycle according to claim 10, wherein said partition plates extend within said interior space for forming three expansion chambers extending along a length of said housing.

12. The muffler for a motorcycle according to claim 11, and further including a first partition and a second partition positioned at predetermined locations along the length of said housing for dividing each of said three expansion chambers into a first expansion chamber, a second expansion chamber and a third expansion chamber.

13. The muffler for a motorcycle according to claim 12, and further including a first conduit having a first end and a second end, said first end being in communication through said first partition with said first expansion chamber and said first end including a plurality of apertures therein for communicating said first expansion chamber with said second expansion chamber.

14. The muffler for a motorcycle according to claim 13, and further including a second conduit having a first end and a second end, said first end being in communication with said second expansion chamber and includes a plurality of apertures therein for communicating said second expansion chamber with said third expansion chamber.

15. The muffler for a motorcycle according to claim 14, wherein said second conduit includes a first portion with a plurality of apertures and a second portion with a plurality of apertures, a blank cap being disposed along the length thereof between said first and second portions for permitting exhaust gas to enter said third expansion chamber through said first portion and exit said muffler through said second portion.

16. The muffler for a motorcycle according to claim 15, and further including a silencing member operatively connected to said second conduit.

17. The muffler for a motorcycle according to claim 13, and further including a blank cap operatively mounted on said first conduit for permitting exhaust gas to enter said first conduit through said plurality of apertures therein.

18. The muffler for a motorcycle according to claim 12, and further including an inner member for insulating heat being provided within said first expansion chamber.

* * * * *